US010160228B2

(12) United States Patent
Tanaka et al.

(10) Patent No.: US 10,160,228 B2
(45) Date of Patent: Dec. 25, 2018

(54) THERMAL HEAD AND THERMAL PRINTER WITH IMPROVED SEALABILITY

(71) Applicant: KYOCERA Corporation, Kyoto-shi, Kyoto (JP)

(72) Inventors: Yui Tanaka, Muko (JP); Youichi Moto, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/538,344

(22) PCT Filed: Dec. 22, 2015

(86) PCT No.: PCT/JP2015/085780

§ 371 (c)(1),
(2) Date: Jun. 21, 2017

(87) PCT Pub. No.: WO2016/104479

PCT Pub. Date: Jun. 30, 2016

(65) Prior Publication Data

US 2018/0015734 A1 Jan. 18, 2018

(30) Foreign Application Priority Data

Dec. 25, 2014 (JP) ..... 2014-262677

(51) Int. Cl.
*B41J 2/335* (2006.01)

(52) U.S. Cl.
CPC ..... *B41J 2/33535* (2013.01); *B41J 2/3352* (2013.01); *B41J 2/3353* (2013.01); *B41J 2/3354* (2013.01); *B41J 2/3355* (2013.01); *B41J 2/3357* (2013.01); *B41J 2/33515* (2013.01); *B41J 2/3351* (2013.01); *B41J 2/3359* (2013.01)

(58) Field of Classification Search
CPC .... B41J 2/33535; B41J 2/3353; B41J 2/3355; B41J 2/3357
See application file for complete search history.

(56) References Cited

U.S. PATENT DOCUMENTS

| | | | | |
|---|---|---|---|---|
| 5,485,192 | A | 1/1996 | Nagahata et al. | |
| 2012/0287216 | A1 | 11/2012 | Yamaji | |
| 2015/0009270 | A1* | 1/2015 | Hirose | B41J 2/3351 347/203 |

FOREIGN PATENT DOCUMENTS

| | | | |
|---|---|---|---|
| JP | 07-195719 | A | 8/1995 |
| JP | 2011-156665 | A | 8/2011 |
| WO | 2013/129020 | A1 | 9/2013 |

OTHER PUBLICATIONS

International Search Report (Form PCT/ISA/210) issued in PCT/JP2015/085780, dated Mar. 22, 2016.

(Continued)

*Primary Examiner* — Bradley Thies
(74) *Attorney, Agent, or Firm* — Volpe and Koenig, P.C.

(57) ABSTRACT

A thermal head includes a substrate, a heat storage layer disposed on the substrate and including a bulging portion, heating elements disposed on the bulging portion, a protective layer disposed on the heating elements, and a covering layer disposed on the protective layer. The covering layer includes a first portion disposed apart from the bulging portion, and a second portion disposed between the bulging portion and the first portion. The height of the second portion from the substrate is smaller than the height of the first portion from the substrate.

14 Claims, 8 Drawing Sheets

(56) References Cited

OTHER PUBLICATIONS

Written Opinion (Form PCT/ISA/237) issued in PCT/JP2015/085780 , dated Mar. 22, 2016.

* cited by examiner

THERMAL HEAD AND THERMAL PRINTER WITH IMPROVED SEALABILITY

TECHNICAL FIELD

The present invention relates to a thermal head and a thermal printer.

BACKGROUND ART

To date, various thermal heads have been developed for use as a printing device for a facsimile, a video printer, or the like. For example, a known thermal head includes a substrate, a heat storage layer disposed on the substrate and including a bulging portion, a heating element disposed on the bulging portion, a protective layer disposed on the heating element, and a covering layer disposed on the protective layer (see, for example, PTL 1).

CITATION LIST

Patent Literature

PTL 1: Japanese Unexamined Patent Application Publication No. 07-195719

SUMMARY OF INVENTION

Technical Problem

However, the thermal head described above has a problem in that the covering layer is formed apart from the bulging portion and the sealability is still low.

Solution to Problem

According to an embodiment, a thermal head includes a substrate, a heat storage layer disposed on the substrate and comprising a bulging portion, a heating element disposed on the bulging portion, a protective layer disposed on the heating element, and a covering layer disposed on the protective layer. The covering layer includes a first portion disposed apart from the bulging portion, and a second portion disposed between the bulging portion and the first portion. A height of the second portion from the substrate is smaller than a height of the first portion from the substrate.

According to an embodiment, a thermal printer includes the thermal head described above, a transport mechanism that transports a recording medium onto the heating element, and a pressing mechanism that presses the recording medium against the heating element.

Advantageous Effects of Invention

With the present invention, the sealability of the thermal head can be improved.

DESCRIPTION OF EMBODIMENTS

First Embodiment

Figure 1:
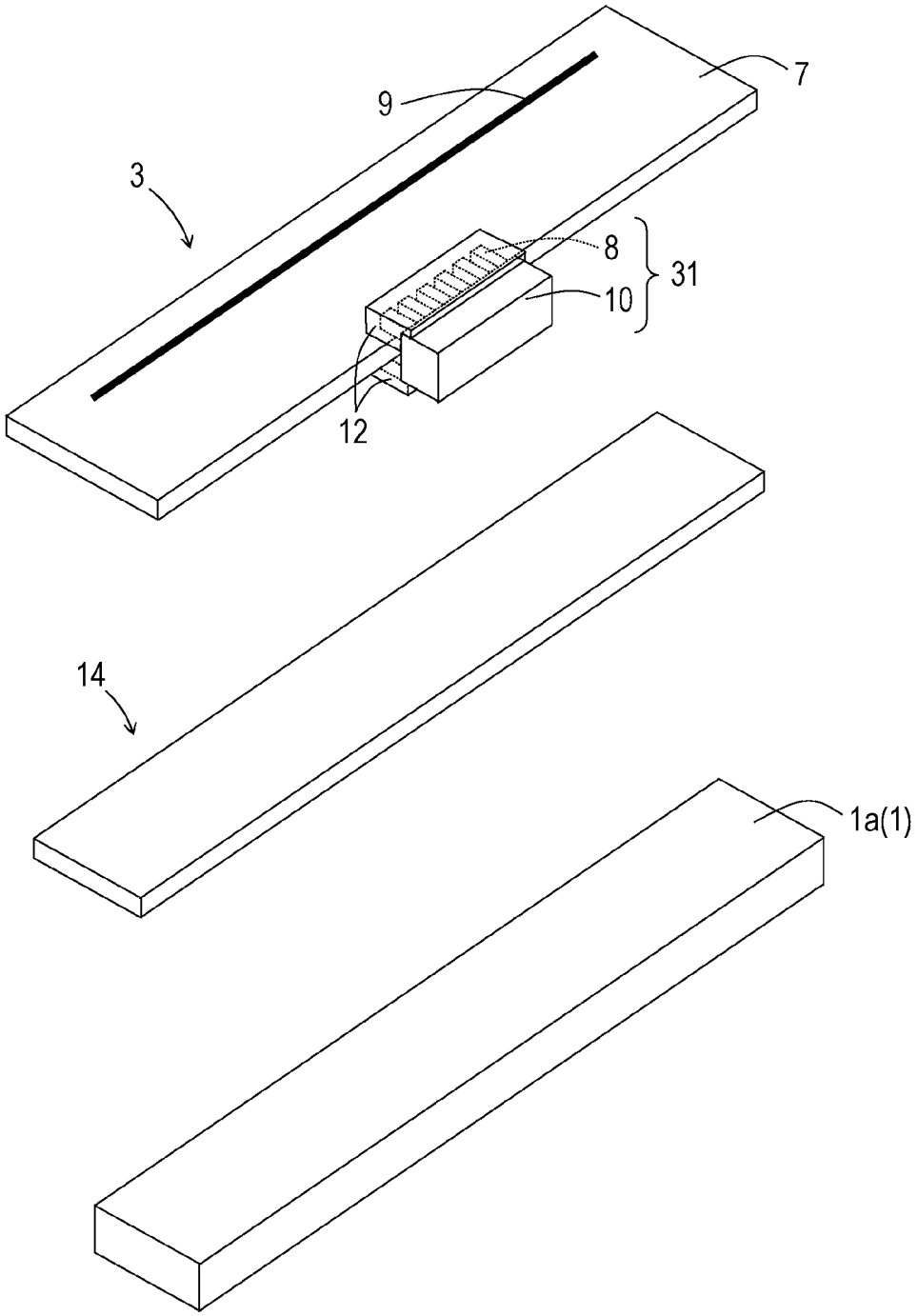
FIG. 1 is a schematic exploded perspective view of a thermal head according to a first embodiment.
Figure 2:
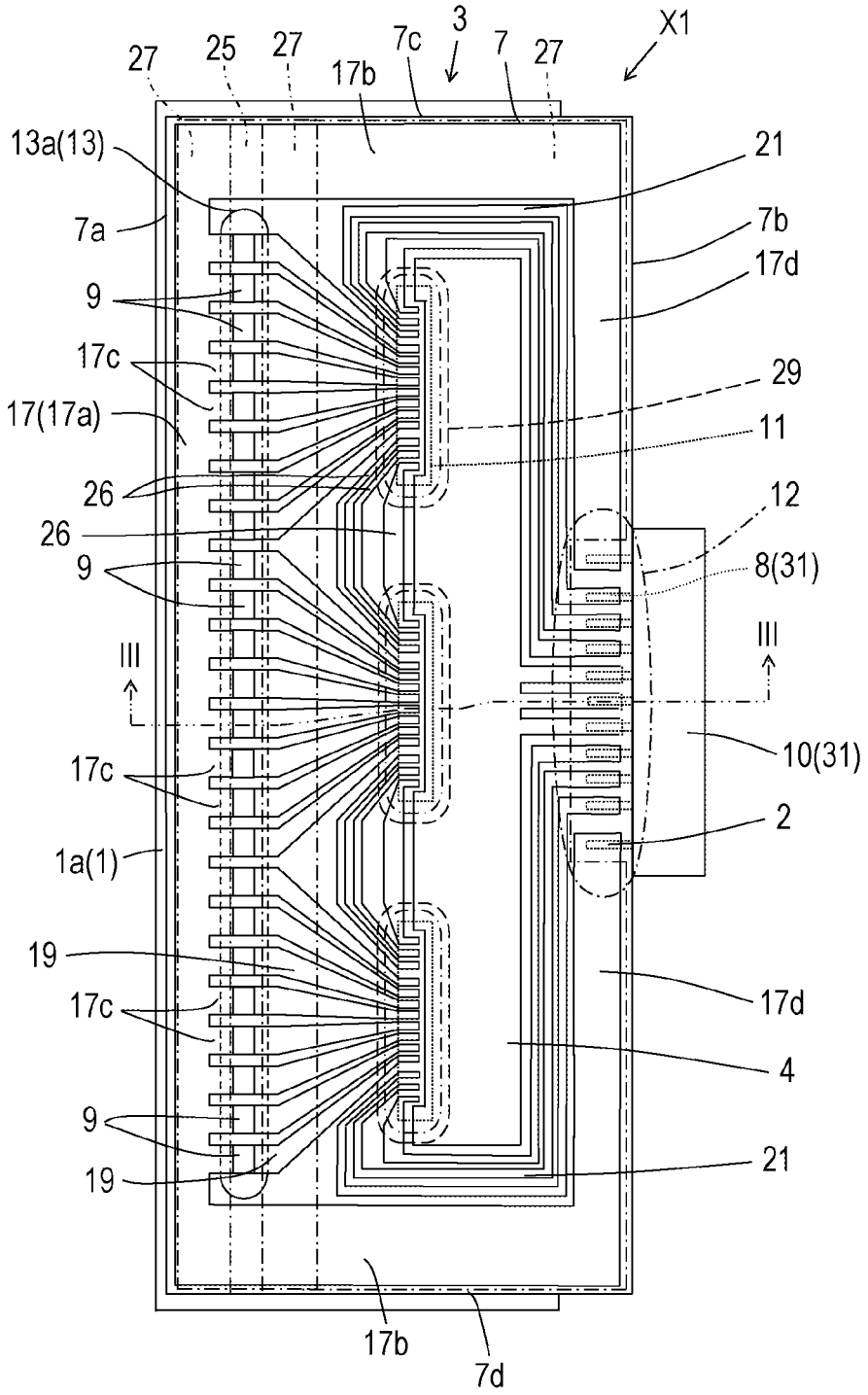
FIG. 2 is a plan view of the thermal head illustrated in FIG. 1.
Figure 3:
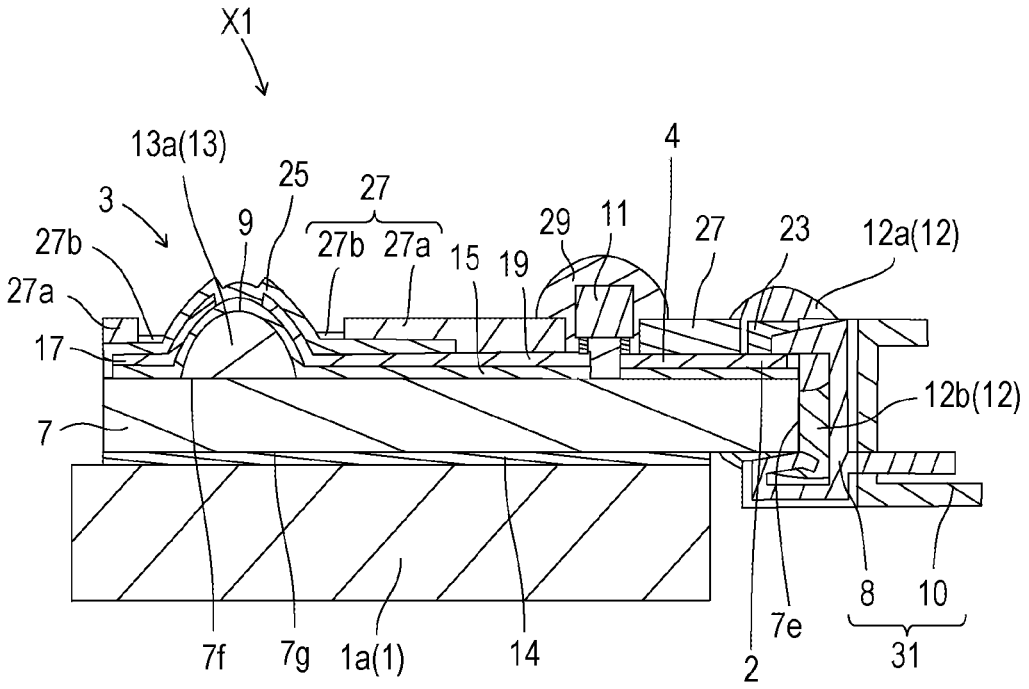
FIG. 3 is a sectional view taken along line III-III in FIG. 2.
Figure 4A:
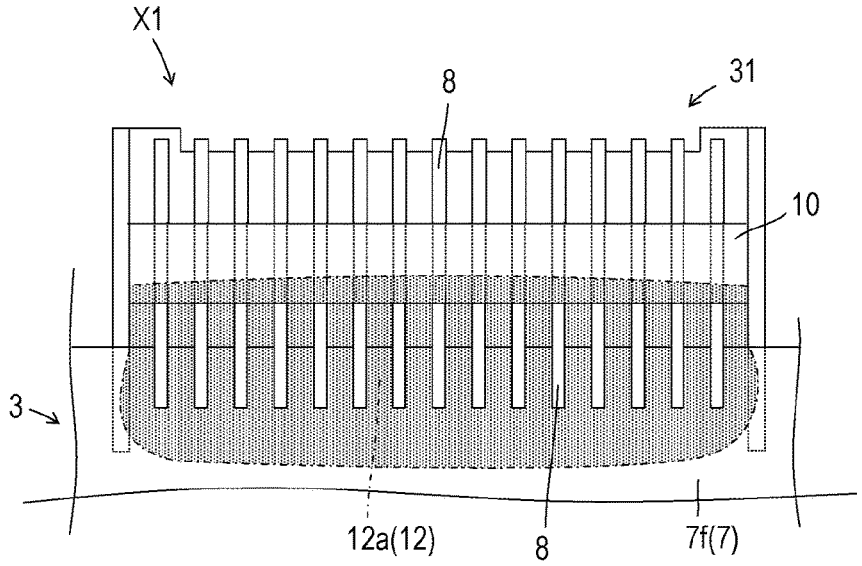
FIGS. 4(*a*) and 4(*b*) illustrate a region near a connector of the thermal head according to the first embodiment, FIG. 4(*a*) is an enlarged top view, and FIG. 4(*b*) is an enlarged bottom view.
Figure 4B:
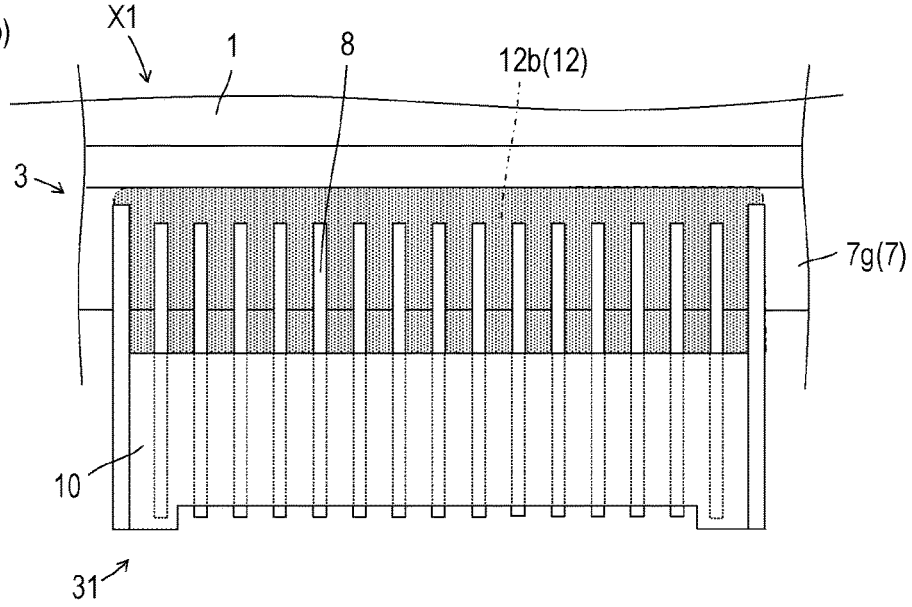

Hereinafter, a thermal head X1 will be described with reference to FIGS. 1 to 5. FIG. 1 schematically illustrates the structure of the thermal head X1. In FIG. 2, a protective layer 25, a covering layer 27, and a sealing member 12 are schematically shown by alternate long and short dash lines. In FIG. 4, a region in which the sealing member 12 is disposed is shown by a broken line.

The thermal head X1 includes a head base body 3, a connector 31, the sealing member 12, a heat sink 1, and an adhesive member 14. In the thermal head X1, the head base body 3 is placed on the heat sink 1 via the adhesive member 14. When a voltage is applied from the outside, the head base body 3 causes heating elements 9 to generate heat to print an image on a recording medium (not shown). The connector 31 electrically connects the head base body 3 to the outside. The sealing member 12 joins the connector 31 and the head base body 3 to each other. The heat sink 1 dissipates heat of the head base body 3. The adhesive member 14 bonds the head base body 3 and the heat sink 1 to each other.

The heat sink 1 is rectangular-parallelepiped-shaped and includes a base portion 1*a* on which a substrate 7 is placed. The heat sink 1 is made of, for example, a metal material, such as copper, iron, or aluminum. The heat sink 1 has a function of dissipating a part of heat that is generated by the heating elements 9 of the head base body 3 and that does not contribute to printing.

The head base body 3 is rectangular in a plan view. Components of the thermal head X1 are disposed on the substrate 7 of the head base body 3. The head base body 3 has a function of printing an image on a recording medium (not shown) in accordance with an electric signal supplied from the outside.

The adhesive member 14 is disposed on an upper surface of the base portion 1*a* of the heat sink 1 and joins the head base body 3 and the heat sink 1 to each other. Examples of the adhesive member 14 include a double-sided tape and a resin-based adhesive.

Hereinafter, the components of the head base body 3 will be described.

The substrate 7 is disposed on the base portion 1*a* of the heat sink 1 and rectangular in a plan view. Therefore, the substrate 7 has one long side 7*a*, the other long side 7*b*, one short side 7*c*, the other short side 7*d*, a side surface 7*e*, a first main surface 7*f*, and a second main surface 7*g*. The side surface 7*e* is disposed near the connector 31. The components of the head base body 3 are disposed on the first main surface 7*f*. The second main surface 7*g* is disposed near the heat sink 1. The substrate 7 is made of, for example, an electrically insulating material, such as alumina ceramics, or a semiconductor material, such as single-crystal silicon.

A heat storage layer 13 is disposed on the first main surface 7*f* of the substrate 7. The heat storage layer 13 includes a bulging portion 13*a* that protrudes upward from the substrate 7. The bulging portion 13*a* extends in a direction in which the plurality of heating elements 9 is arranged and has a substantially semielliptical cross section. The bulging portion 13*a* functions to appropriately press a recording medium P (see FIG. 7), on which an image is to be printed, against the protective layer 25 on the heating elements 9. Preferably, the height of the bulging portion 13*a* from the substrate 7 is in the range of 15 to 90 μm.

The heat storage layer 13 is made of glass having a low thermal conductivity and temporarily stores a part of heat generated by the heating elements 9. Therefore, the time needed to increase the temperature of the heating elements 9 can be reduced, and the heat storage layer 13 functions to increase the thermal responsiveness of the thermal head X1. For example, the heat storage layer 13 can be formed by preparing a predetermined glass paste by mixing glass powder and an appropriate organic solvent, applying the glass paste to the upper surface of the substrate 7 by using a known method such as screen printing, and firing the glass paste.

A resistor layer 15 is disposed on an upper surface of the substrate 7 and an upper surface of the heat storage layer 13. Various electrodes of the head base body 3 are disposed on the resistor layer 15. The resistor layer 15 is patterned in the same shapes as the various electrodes of the head base body 3. The resistor layer 15 includes exposed regions, which are exposed, between a common electrode 17 and individual electrodes 19. The exposed regions constitute the heating elements 9 and are arranged in a row on the bulging portion 13*a*.

The plurality of heating elements 9, although illustrated in a simplified manner in FIG. 2 for convenience of description, is arranged, for example, with a density of 100 dpi to 2400 dots per inch (dpi). The resistor layer 15 is made of a material having a comparatively high resistance, such as a TaN-based material, a TaSiO-based material, a TaSiNO-based material, a TiSiO-based material, TiSiCO-based material, or a NbSiO-based material. Therefore, when a voltage is applied to the heating elements 9, the heating elements 9 generate heat by Joule heating.

The common electrode 17 includes main wiring portions 17*a* and 17*d*, sub-wiring portions 17*b*, and lead portions 17*c*. The common electrode 17 electrically connects the plurality of heating elements 9 and the connector 31 to each other. The main wiring portion 17*a* extends along the one long side 7*a* of the substrate 7. The sub-wiring portions 17*b* extend respectively along the one short side 7*c* and the other short side 7*d* of the substrate 7. The lead portions 17*c* individually extend from the main wiring portion 17*a* toward the heating elements 9. The main wiring portion 17*d* extends along the other long side 7*b* of the substrate 7.

The plurality of individual electrodes 19 electrically connects the heating elements 9 to drive ICs 11. The individual electrodes 19 divide the plurality of heating elements 9 into a plurality of groups and electrically connect the heating elements 9 of each group to a corresponding one of the drive ICs 11.

A plurality of IC-connector connection electrodes 21 electrically connects the drive ICs 11 to the connector 31. The plurality of IC-connector connection electrodes 21, which is connected to the drive ICs 11, includes a plurality of wires having different functions.

A ground electrode 4 is disposed so as to be surrounded by the individual electrodes 19, the IC-connector connection electrodes 21, and the main wiring portions 17*d* of the common electrode 17. The ground electrode 4 has a large area. The ground electrode 4 has a ground electric potential in the range of 0 to 1 V.

Connection terminals 2 are disposed near the other long side 7*b* of the substrate 7 so as to connect the common electrode 17, the individual electrodes 19, the IC-connector connection electrodes 21, and the ground electrode 4 to the connector 31. The connection terminals 2 correspond to connector pins 8. When connecting the connection terminals 2 to the connector 31, the connector pins 8 and the connection terminals 2 are connected in such a way that the connection terminals 2 are electrically insulated from each other.

The plurality of IC-IC connection electrodes 26 electrically connects the adjacent drive ICs 11. The plurality of IC-IC connection electrodes 26 corresponds to the IC-connector connection electrodes 21 and transmits various signals to the adjacent drive ICs 11.

The various electrodes of the head base body 3 are formed by, for example, successively stacking material layers of these electrodes on the heat storage layer 13 to form a stacked body by using a known thin-film forming technology such as sputtering, and then patterning the stacked body in a predetermined pattern by using a known photoetching method or the like. The various electrodes of the head base body 3 can be simultaneously formed through the same process.

The drive ICs 11 are disposed so as to correspond to the groups of the plurality of heating elements 9. Each of the drive ICs 11 is connected to the other end portion of each of the individual electrodes 19 and one end portion of each of the IC-connector connection electrodes 21. The drive IC 11 has a function of controlling energization of the heating elements 9. A switching member that includes a plurality of switching devices may be used as the drive IC 11.

Each of the drive ICs 11 is sealed with a hard coating 29, which is made of a resin such as epoxy resin or silicone resin, in a state in which the drive IC 11 is connected to the individual electrodes 19, the IC-IC connection electrodes 26, and the IC-connector connection electrodes 21.

The protective layer 25, which covers the heating elements 9, a part of the common electrode 17, and parts of the individual electrodes 19, is formed on the heat storage layer 13, which is disposed on the first main surface 7*f* of the substrate 7.

The protective layer 25 protects covered regions of the heating elements 9, the common electrode 17, and the individual electrodes 19 from corrosion due to adhesion of water or the like contained in air or from wear due to contact with a recording medium on which an image is to be printed. The protective layer 25 may be made of SiN, SiO2, SiON, SiC, diamond-like carbon, or the like. The protective layer 25 may have only one layer or may have a stack of layers. The protective layer 25 can be formed by using a thin-film forming technology, such as sputtering, or a thick film forming technology, such as screen printing.

The covering layer 27, which partially covers the common electrode 17, the individual electrodes 19, and the IC-connector connection electrodes 21, is disposed on the substrate 7. The covering layer 27 protects the covered regions of the common electrode 17, the individual electrodes 19, the IC-IC connection electrodes 26, and the IC-connector connection electrodes 21 from oxidation due to contact with air or from corrosion due to adhesion of water or the like contained in air.

The connector 31 and the head base body 3 are fixed to each other via the connector pins 8, an electroconductive joining material 23, and the sealing member 12. The electroconductive joining material 23 is disposed between the connection terminals 2 and the connector pins 8. Examples of the electroconductive joining material 23 include a solder and an anisotropic conductive adhesive in which electroconductive particles are mixed in an electrically insulating resin. A plating layer (not shown), which is made of Ni, Au, or Pd, may be disposed between the electroconductive joining material 23 and the connection terminals 2. The electroconductive joining material 23 may be omitted. In this case, by using a clip-type pin as the connector pin 8, the connection terminals 2 and the connector pins 8 may be directly and electrically connected to each other by holding the substrate 7 between the connector pins 8.

The connector 31 includes the plurality of connector pins 8 and a housing 10 that contains the plurality of connector pins 8. One part of each of the plurality of connector pins 8 is exposed to the outside of the housing 10, and the other part of each of the plurality of connector pins 8 is contained in the housing 10. The plurality of the connector pins 8 is electrically connected to the connection terminals 2 of the head base body 3 and electrically connected to the various electrodes of the head base body 3.

The connector pins 8 are made of an electroconductive material, such a metal or an alloy. The housing 10 may be made of an insulating material, such as a resin material. Examples of the resin material include polyamide (PA), polybutylene terephthalate (PBT), and liquid crystal polymer (LCP).

The sealing member 12 includes a first sealing member 12*a* and a second sealing member 12*b*. The first sealing member 12*a* is located on the first main surface 7*f* of the substrate 7, and the second sealing member 12*b* is located on the second main surface 7*g* of the substrate 7. The first sealing member 12*a* seals the connector pins 8 and the various electrodes. The second sealing member 12*b* seals the connector pins 8.

The sealing member 12 is disposed so that the connection terminals 2 and the connector pins 8 are not exposed to the outside. The sealing member 12 may be made of, for example, an epoxy thermosetting resin, a UV curable resin, or a visible-light curable resin. The first sealing member 12*a* and the second sealing member 12*b* may be made of the same material or different materials.

Figure 5:
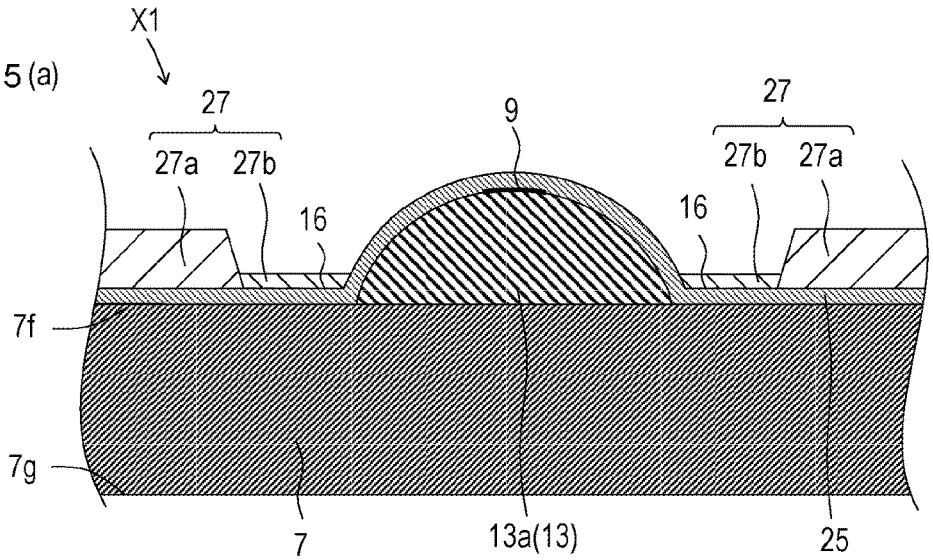
FIGS. 5(*a*) and 5(*b*) illustrate the thermal head according to the first embodiment, FIG. 5(*a*) is a sectional view, and FIG. 5(*b*) is a sectional view when a recording medium is being transported.
Figure 5:
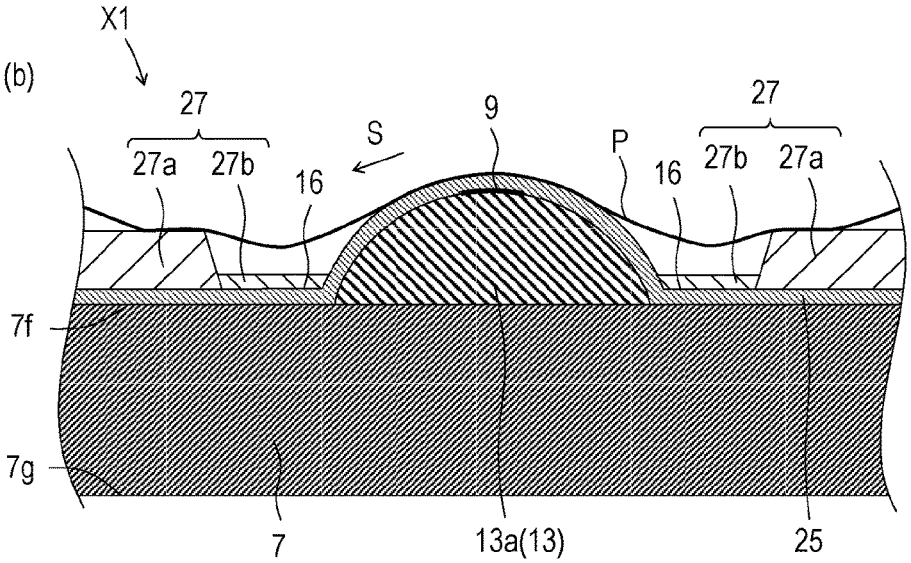

Referring to FIG. 5, the covering layer 27 will be described in detail. FIG. 5 illustrates a state in which a recording medium P is being transported. In FIG. 5, a platen roller, the resistor layer, and the various electrodes are omitted. The same applies to FIGS. 7 to 10. In FIG. 5(*b*), the transport direction of the recording medium P is indicated by "S", and the same applies to FIGS. 7 to 10.

The covering layer 27 includes a first portion 27*a* and a second portion 27*b* and is disposed on the protective layer 25. The thickness of the second portion 27*b* is smaller than the thickness of the first portion 27*a*. The covering layer 27 has a function of sealing the heating elements 9 and the various electrodes disposed underneath.

The first portion 27*a* is disposed apart from the bulging portion 13*a* with a space (a gap 16) therebetween in a plan view. The first portion 27*a* is formed on substantially the entire area on the substrate 7. To be specific, the first portion 27*a* is disposed between the bulging portion 13*a* and the one long side 7*a* of the substrate 7 so as to extend in the main scanning direction. The first portion 27*a* is disposed also between the bulging portion 13*a* and the other long side 7*b* of the substrate 7 so as to extend in the main scanning direction. The first portion 27*a* that is disposed between the bulging portion 13*a* and the other long side 7*b* of the substrate 7 has openings in which the drive ICs 11 are disposed and openings in which the connector pins 8 are disposed.

The first portion 27*a* has a function of protecting the components that are disposed on the substrate 7. The first portion 27*a* also has a function of protecting the components on the substrate 7 from contact with a recording medium P (see FIG. 5(*b*)) that is being transported.

Therefore, preferably, the first portion 27*a* has a thickness in the range of 10 to 30 μm. When the thickness is 10 μm or larger, the wear resistance of the first portion 27*a* can be improved. When the thickness is 30 μm or smaller, the first portion 17*a* is not likely to hinder transportation of the recording medium P.

The first portion 27*a* needs to be corrosion resistant and wear resistant and may be made of, for example, an epoxy-based resin material or a polyimide-based resin material. Examples of the epoxy-based resin material include a bisphenol A epoxy resin and a bisphenol F epoxy resin.

The second portion 27*b* is formed continuously from the first portion 27*a* and disposed between the first portion 27*a* and the bulging portion 13*a*. Therefore, the second portion 27*b* is disposed on the gap 16. Although not illustrated in FIG. 5, the second portion 27*b* extends in the main scanning direction. The second portion 27*b* seals a part of the protective layer 25 located in the gap 16 between the first portion 27*a* and the bulging portion 13*a* and seals the heating elements 9 and the various electrodes formed in the protective layer 25.

The thickness of the second portion 27*b* smaller than the thickness of the first portion 27*a*, and the thickness of the second portion 27*b* may be in the range of 0.01 to 1 μm. When the thickness of the second portion 27*b* is 0.01 μm or larger, the second portion 27*b* can increase the sealability of the thermal head X1. When the thickness of the second portion 27*b* is 1 μm or smaller, the second portion 27*b* is not likely to hinder transportation of the recording medium P.

The second portion 27*b* needs to be corrosion resistant and may be made of, for example, an epoxy-based resin material or a polyimide-based resin material. Examples of the epoxy-based resin material include a bisphenol A epoxy resin.

In a thermal head, components disposed on a substrate are covered by a protective layer, a covering layer, a hard coating, or a sealing member so that the components may not corrode. The covering layer is highly corrosion resistant to external environment. Preferably, the covering layer is formed so as to extend to a region near heating elements in order to improve the sealability of the thermal head.

However, if the covering layer is formed so as to extend to a region near the heating element, a platen roller located on the heating elements may contact the covering layer. If this occurs, the pressing force of the platen roller is dispersed, which may negatively affect printing of an image on a recording medium P. Therefore, it is necessary to form the covering layer apart from a bulging portion with a predetermined space therebetween so that the recording medium can be transported onto the heating elements.

As a result, only the protective layer is formed in a predetermined space between the bulging portion and the covering layer. Then, if the protective layer has a defect such as a pin hole, the components on the substrate may communicate with the outside, and a problem arises in that the sealability of the thermal head is reduced. Then, the components on the substrate may corrode.

In contrast, the covering layer 27 includes the first portion 27*a*, which is disposed apart from the bulging portion 13*a* (with the gap 16 therebetween), and the second portion 27*b*, which is disposed between the bulging portion 13*a* and the first portion 27*a*. The height of the second portion 27*b* from the substrate 7 is smaller than the height of the first portion 27*a* from the substrate 7.

Therefore, the second portion 27*b* of the covering layer 27 can sealing the gap 16. Moreover, as illustrated in FIG. 5(*b*), the second portion 27*b* is not likely to contact the recording medium P because the recording medium P is lifted by the first portion 27*a*.

As a result, while sealing the gap 16 with the second portion 27*b*, wear of the second portion 27*b* can be suppressed by the first portion 27*a*, and the sealability of the thermal head X1 can be improved.

Note that the height of the first portion 27*a* from the substrate 7 is the height of a part of the first portion 27*a* having the largest height from the substrate 7, and the height of the second portion 27*b* from the substrate 7 is the height of a part of the second portion 27*b* having the largest height from the substrate 7. The heights from the substrate 7 can be measured, for example, by using a profilometer. Alternatively, the heights from the substrate 7 can be measured by cutting the thermal head X1 in the thickness direction and measuring the sectional surface.

Since the thickness of the second portion 27*b* is smaller than the thickness of the first portion 27*a*, even though the second portion 27*b* is disposed so as to fill the gap 16, the recording medium P is not likely to contact the second portion 27*b*. As a result, the sealability of the thermal head X1 can be improved.

Preferably, the first portion 27*a* and the second portion 27*b* are made of materials of the same type. In this case, the first portion 27*a* and the second portion 27*b* can be appropriately connected to each other. Moreover, the sealability of the thermal head X1 can be improved by selecting a resin material of the second portion 27*b* from materials that have high wettability to the ceramic material of the protective layer 25.

Even when the second portion 27*b* contacts the recording medium P, since the first portion 27*a* and the second portion 27*b* are made of materials of the same type, the first portion 27*a* and the second portion 27*b* have substantially the same coefficient of friction against the recording medium P, and the probability of occurrence of sticking can be reduced.

To be specific, preferably, the first portion 27*a* is made of a composite of a bisphenol A epoxy resin and a bisphenol F epoxy resin and the second portion 27*b* is made of a bisphenol A epoxy resin. In this case, the sealability of the thermal head X1 can be improved.

When the first portion 27*a* is made of a composite of a bisphenol A epoxy resin and a bisphenol F epoxy resin and the second portion 27*b* is made of a bisphenol A epoxy resin, the electrical resistance of the second portion 27*b* is higher than the electrical resistance 27*b* of the first portion 27*a*. Therefore, an electric current does not easily flow through the second portion 27*b*, which is disposed near the heating elements 9, and the insulation of the thermal head X1 can be improved.

The electrical resistance of each of the first portion 27*a* and the second portion 27*b* can be measured by measuring electrical resistance per unit length by using an ohmmeter.

When the first portion 27*a* and the second portion 27*b* contain a bisphenol A epoxy resin and the content ratio of the bisphenol A epoxy resin in the second portion 27*b* is larger than the content ratio of the bisphenol A epoxy resin in the first portion 27*a*, the heat resistance and the wear resistance of the second portion 27*b* can be improved. Thus, the durability of the thermal head X1 can be improved.

In the above case, it is possible to distinguish the first portion 27*a* from the second portion 27*b* by the presence of a bisphenol F epoxy resin. A portion of the covering layer 27 in which the bisphenol F epoxy resin is present is the first portion 27*a*, and a portion of the covering layer 27 in which the bisphenol F epoxy resin is not present is the second portion 27*b*.

The covering layer 27 may be formed, for example, by using the following method.

To form the first portion 27*a*, a resin for the first portion 27*a* is made by mixing a bisphenol A epoxy resin, a bisphenol F epoxy resin, and imidazole. To form the second portion 27*b*, a resin for the second portion 27*b* is made by mixing the bisphenol A epoxy resin and imidazole.

Next, the resin for the first portion 27*a* is applied to the substrate 7 by printing. At this time, the resin for the first portion 27*a* is applied so that the gap 16 is formed between the resin for the first portion 27*a* and the bulging portion 13*a*.

Next, the resin for the second portion 27*b* is applied to the gap 16 between the bulging portion 13*a* and the resin for the first portion 27*a*. The resin for the second portion 27*b* is applied so as to seal the gap 16 by screen printing or by using a dispenser or the like.

The covering layer 27 may be formed by applying a mixture of the resin for the first portion 27*a* and the resin for the second portion 27*b*. In this case, the covering layer 27 can be formed by applying the mixture of the resin for the first portion 27*a* and the resin for the second portion 27*b*, letting the mixture to stand for a predetermined time after being applied, and curing the mixture.

Next, a thermal printer Z1 will be described with reference to FIG. 6.

Figure 6:
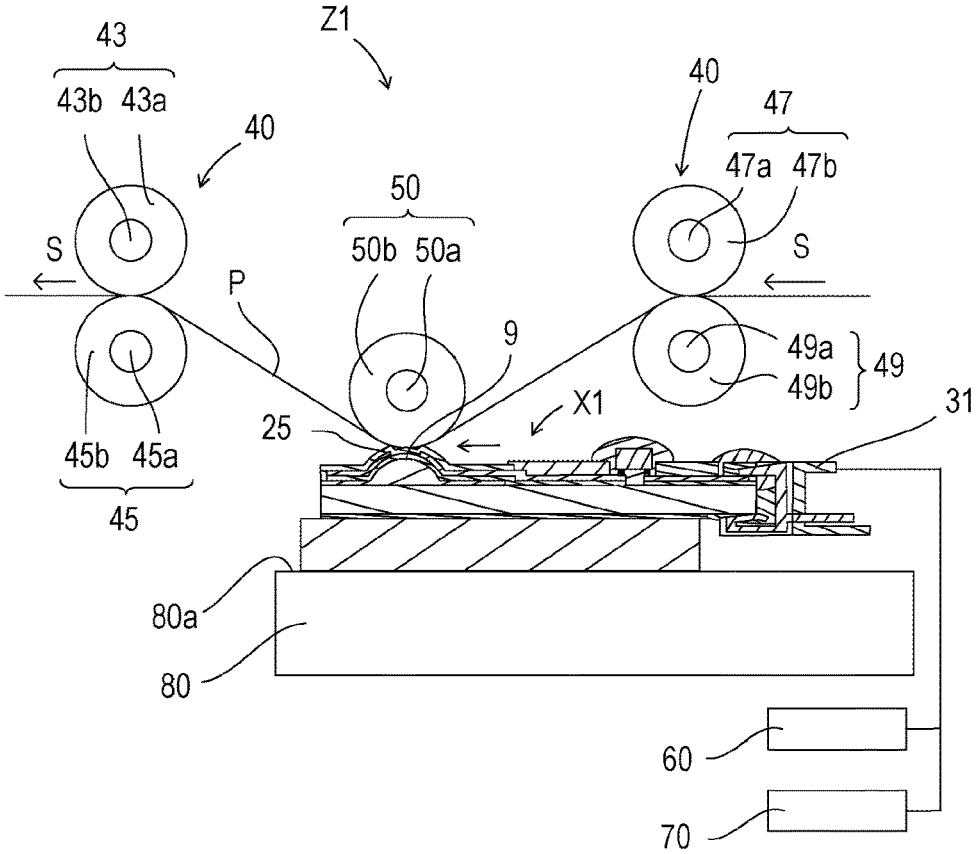
FIG. 6 is schematic view of a thermal printer according to the first embodiment.

As illustrated in FIG. 6, the thermal printer Z1 according to the present embodiment includes the thermal head X1 described above; a transport mechanism 40; a platen roller 50, which is a pressing mechanism; a power supply 60; and a control device 70. The thermal head X1 is attached to an attachment surface 80*a* of an attachment member 80, which is disposed on a housing (not shown) of the thermal printer Z1. The thermal head X1 is attached to the attachment member 80 so as to extend in the main scanning direction, which is a direction perpendicular to the transport direction S of a recording medium P described below.

The transport mechanism 40 includes a drive unit (not shown) and transport rollers 43, 45, 47, and 49. The transport mechanism 40 transports the recording medium P, which is thermal paper, printing paper to which ink is transferred, or the like, in the direction of arrow S in FIG. 6 to transport the recording medium P onto the protective layer 25, which is located on the plurality of heating elements 9 of the thermal head X1. The drive unit has a function of driving the transport rollers 43, 45, 47, and 49. For example, a motor may be used as the drive unit. For example, the transport rollers 43, 45, 47, and 49 are made by covering cylindrical shafts 43*a*, 45*a*, 47*a*, and 49*a*, which are made of a metal such as a stainless steel, with elastic members 43*b*, 45*b*, 47*b*, and 49*b*, which are made of butadiene rubber or the like. Although not shown in the figure, if the recording medium P is printing paper to which ink is transferred or the like, an ink film is transported together with the recording medium P to a space between the recording medium P and the heating elements 9 of the thermal head X1.

The platen roller 50 has a function of pressing the recording medium P against the protective layer 25, which is located on the heating elements 9 of the thermal head X1. The platen roller 50 is disposed so as to extend in a direction perpendicular to the transport direction S of the recording medium P. Both end portions of the platen roller 50 are supported and fixed so that the platen roller 50 can rotate while pressing the recording medium P against the heating elements 9. For example, the platen roller 50 can be made by covering a cylindrical shaft 50*a*, which is made of a metal such as a stainless steel, with an elastic member 50*b*, which is made of butadiene rubber or the like.

The power supply 60 has a function of supplying an electric current for causing the heating elements 9 of the thermal head X1 to generate heat as described above and supplying an electric current for driving the drive ICs 11. The control device 70 has a function of supplying control signals, for controlling operations of the drive ICs 11, to the drive ICs 11 in order to selectively cause the heating elements 9 of the thermal head X1 to generate heat.

As illustrated in FIG. 6, the thermal printer Z1 prints a predetermined image on the recording medium P by selectively causing the heating elements 9 to generate heat by using the power supply 60 and the control device 70 while transporting the recording medium P onto the heating elements 9 by using the transport mechanism 40 and pressing the recording medium P against the heating elements 9 of the thermal head X1 by using the platen roller 50. If the recording medium P is printing paper or the like, the thermal printer Z1 prints an image on the recording medium P by thermally transferring ink of an ink film (not shown), which is transported together with the recording medium P, to the recording medium P.

In the above description, the platen roller 50 is used as the pressing mechanism. However, a pressing mechanism that is not the platen roller 50 may be used.

Second Embodiment

Figure 7:
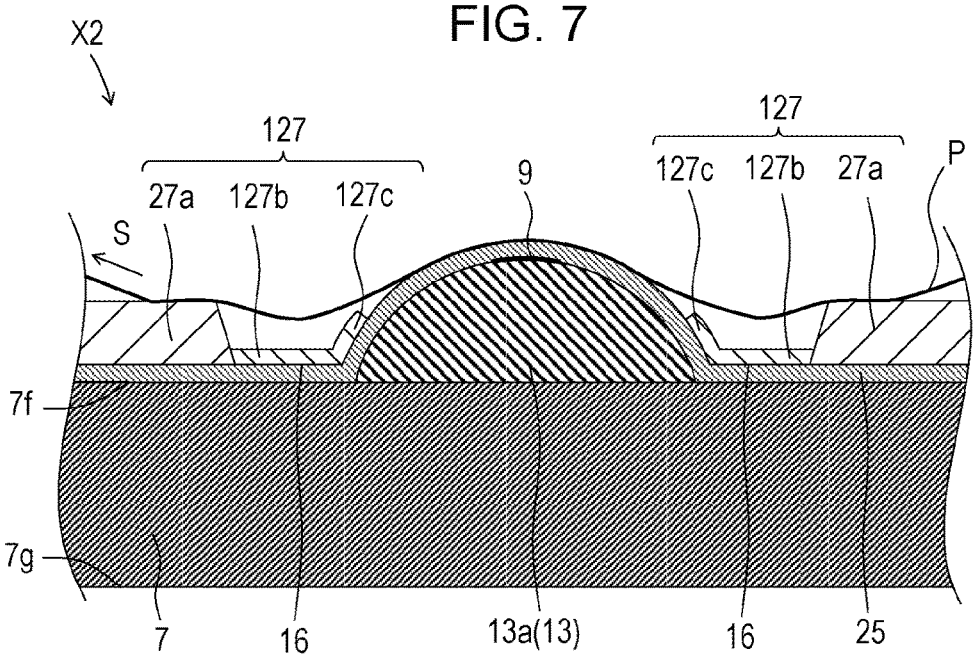
FIG. 7 is a sectional view illustrating a thermal head according to a second embodiment when a recording medium is being transported.

Referring to FIG. 7, a thermal head X2 will be described. Hereinafter, components that are the same as those of the thermal head X1 will be denoted by the same numerals. The thermal head X2 includes a covering layer 127 that is different from the covering layer 27 of the thermal head X1.

The covering layer 127 includes the first portion 27*a*, a second portion 127*b*, and a third portion 127*c* and is disposed on the protective layer 25. The third portion 127*c* is disposed on the bulging portion 13*a* and integrally formed with the second portion 127*b*.

The third portion 127*c* is formed continuously from the second portion 127*b* and disposed on the bulging portion 13*a*. Therefore, the second portion 127*b* and the third portion 127*c* seal the edge of the bulging portion 13*a*.

As with the second portion 127*b*, the thickness of the third portion 127*c* is smaller than the thickness of the first portion 27*a*, and the thickness of the third portion 127*c* may be in the range of 0.01 to 1 μm. As with the second portion 127*b*, the third portion 127*c* may be made of an epoxy-based resin material, a polyimide-based resin material, or the like.

The covering layer 127 includes the third portion 127*c* disposed on the bulging portion 13*a*. Therefore, the second portion 127*b* and the third portion 127*c* cover the edge of the bulging portion 13*a*, which is near the boundary between the bulging portion 13*a* and the substrate 7. Thus, the sealability of the gap 16 can be improved.

In particular, since the bulging portion 13*a* protrudes upward, the sealability of the covering layer 27 tends to be low in a part of the gap 16 near the boundary between the bulging portion 13*a* and the substrate 7. However, in the thermal head X2, the second portion 127*b* and the third portion 127*c* maintain the sealability of the gap 16.

In the thermal head X2, the height of the third portion 127*c* from the substrate 7 is smaller than the height of the first portion 27*a* from the substrate 7. Therefore, the recording medium P is supported by the first portion 27*a* and transported onto the heating elements 9. As a result, the probability of the recording medium P contacting the third portion 127*c* can be reduced, and the probability of scratching the recording medium P can be reduced.

Moreover, since the thicknesses of the second portion 127*b* and the third portion 127*c* are smaller than the thickness of the first portion 27*a*, transfer of heat generated by the heating elements 9 to the first portion 27*a* through the second portion 127*b* and the third portion 127*c* can be suppressed.

The third portion 127*c* is disposed on a region of the bulging portion 13*a* that is not on the heating elements 9. That is, the third portion 127*c* is not disposed on the heating elements 9. Therefore, heat generated by the heating elements 9 is not transferred through the third portion 127*c* but is transferred to the recording medium P via the protective film 25. As a result, the probability of decrease in the printing efficiency of the thermal head X2 can be reduced.

The third portion 127*c* can be formed simultaneously with the second portion 127*b*. That is, the third portion 127*c* can be formed by applying the resin for the first portion 27*a* so that the gap 16 is formed and then applying resins for the second portion 127*b* and the third portion 127*c* so as to extend from the first portion 127*c* onto the bulging portion 13*a*.

Note that the height of the third portion 127*c* from the substrate 7 is the height of a part of the third portion 127*c* having the largest height from the substrate 7. The height can be measured by using a profilometer.

Third Embodiment

Figure 8:
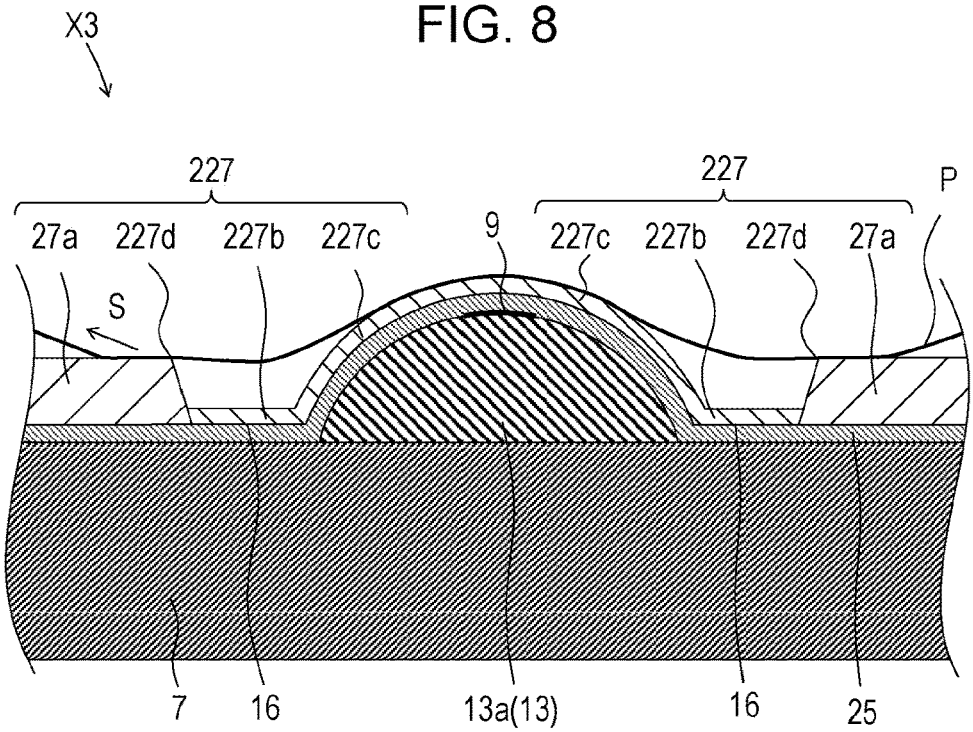
FIG. 8 is a sectional view illustrating a thermal head according to a third embodiment when a recording medium is being transported.

Referring to FIG. 8, a thermal head X3 will be described. The thermal head X3 includes a covering layer 227 that is different from the covering layer 27 of the thermal head X1.

The covering layer 227 includes the first portion 27*a*, a second portion 227*b*, and a third portion 227*c* and is disposed on the protective layer 25. The first portion 27*a* has a corner 227*d* near the bulging portion 13*a*. The second portion 227*b* is disposed in the gap 16 between the first portion 27*a* and the bulging portion 13*a*. The third portion 227*c* is disposed on the bulging portion 13*a* over the entire area of the bulging portion 13*a*.

Since the third portion 227*c* is disposed over the entire area of the bulging portion 13*a*, the third portion 227*c* is disposed over the entirety of an area of the protective layer 25 that is located on the bulging portion 13*a*. Therefore, even if the protective layer 25 has a pin hole, the third portion 227*c* can seal the protective layer 25. Thus, the probability of corrosion of the heating elements 9 and the various electrodes, which are sealed by the protective layer 25, can be reduced.

The arithmetic-average surface roughness (Ra) of the third portion 227*c* is smaller than the arithmetic-average surface roughness (Ra) of the second portion 227*b*. Thus, even if the third portion 227*c* contacts the recording medium P, the probability of scratching the recording medium P can be reduced. Since the height of the second portion 227*b* is smaller than the height of the first portion 27*a*, the probability of the second portion 227*b* contacting the recording medium P is low.

Since the second portion 227*b* is formed in the gap 16 on the substrate 7, which has a rough surface, adhesion between the second portion 227*b* and the substrate 7 can be increased. Therefore, the sealability of the gap 16 can be improved.

The height of the third portion 227*c* from the substrate 7 is greater than the height of the first portion 27*a* from the substrate 7. Also in this case, the recording medium P is guided by the corner 227*d* of the first portion 27*a* toward the heating elements 9, and friction between the recording medium P that is transported and the first portion 27*a*1 is substantially the same as friction between the recording medium P and the third portion 227*c*. Therefore, sticking can be suppressed because the recording medium P is smoothly transported, and the probability of scratching the recording medium P can be reduced.

The height of the first portion 27*a* that is located on the downstream side in the transport direction S of the recording medium P may be smaller than the height of the third portion 227*c* from the substrate 7. In this case, the recording medium P transported from the heating elements 9 is not likely to contact the corner 227*d* of the first portion 27*a* that is located on the downstream side in the transport direction S, and the recording medium P can be smoothly transported.

Fourth Embodiment

Figure 9:
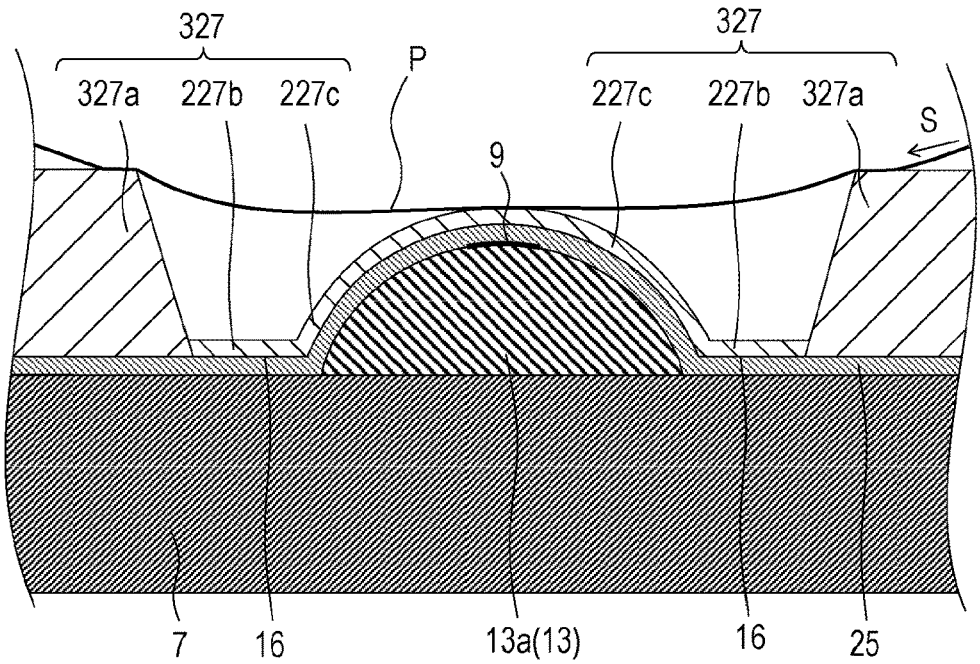
FIG. 9 is a sectional view illustrating a thermal head according to a fourth embodiment when a recording medium is being transported.

Referring to FIG. 9, a thermal head X4 will be described. The thermal head X4 includes a covering layer 327 that is different from the covering layer 227 of the thermal head X3.

The covering layer 327 includes a first portion 327*a*, the second portion 227*b*, and the third portion 227*c* and is disposed on the protective layer 25. The height of the bulging portion 13*a* from the substrate 7 is smaller than the height of the first portion 327*a* from the substrate 7. Therefore, the height of the third portion 227*c* from the substrate 7 is smaller than the height of the first portion 327*a* from the substrate 7.

In the thermal head X4, the height of the bulging portion 13*a* from the substrate 7 is smaller than the height of the first portion 327*a* from the substrate 7. Therefore, the recording medium P is transported as shown in FIG. 9. That is, the recording medium P contacts the first portion 327*a*, which has a larger height from the substrate 7, and then contacts the third portion 227*c*.

As a result, the probability of the second portion 227*b* contacting the recording medium P can be further reduced. Thus, the sealability of the thermal head X4 can be further improved.

Fifth Embodiment

Figure 10:
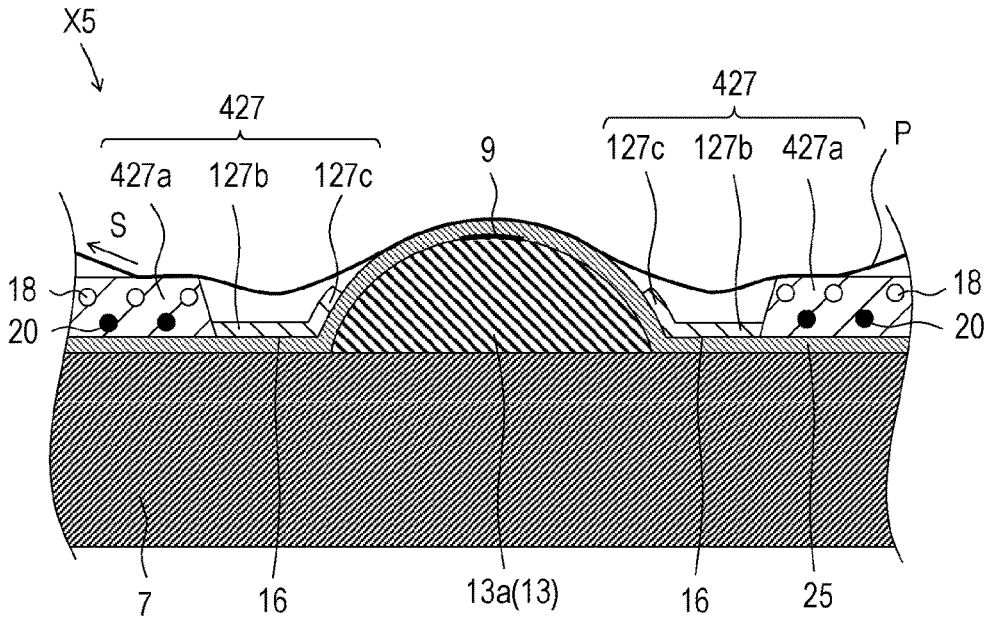
FIG. 10 is a sectional view illustrating a thermal head according to a fifth embodiment when a recording medium is being transported.

Referring to FIG. 10, a thermal head X5 will be described. The thermal head X5 includes a covering layer 427 that is different from the covering layer 127 of the thermal head X2.

The covering layer 427 includes a first portion 427*a*, the second portion 127*b*, and the third portion 127*c* and is disposed on the protective layer 25. The first portion 427*a* contains a filler 18, and the second portion 127*b* and the third portion 127*c* do not contain the filler 18.

The filler 18, for improving the wear resistance of the first portion 27*a*, is contained by 25 to 35 weight %. Examples of the filler include silica, alumina, glass, talc, clay, and mica.

In the thermal head X5, the covering layer 427 is made of a resin, the first portion 427*a* contains the filler 18, and the second portion 127*b* and the third portion 127*c* do not contain the filler 18. Thus, the wear resistance of the first portion 427*a*, which contains the filler 18, can be improved, and the reliability of the thermal head X5 can be improved.

Since the second portion 127*b* and the third portion 127*c* do not include the filler 18, even if the second portion 127*b* and the third portion 127*c* contact the recording medium P, the filler 18 does not contact the recording medium P, and the probability of scratching the recording medium P can be reduced.

The first portion 427*a* contains a pigment 20, and the second portion 127*b* and the third portion 127*c* do not contain the pigment 20.

The pigment 20, for improving the visibility of the first portion 27*a*, is contained by 0.1 to 10 weight %.

In the thermal head X5, the covering layer 427 is made of a resin, the first portion 427*a* contains the pigment 20, and the second portion 127*b* and the third portion 127*c* do not contain the pigment 20. Thus, the wear resistance of the first portion 427*a*, which includes the pigment 20, can be improved, and the reliability of the thermal head X5 can be improved.

Since the second portion 127*b* and the third portion 127*c* do not include the pigment 20, even if the second portion 127*b* and the third portion 127*c* contact the recording medium P, the pigment 20 does not contact the recording medium P, and the probability of scratching the recording medium P can be reduced.

It is difficult to adjust the amount of the first portion 427*a* applied to the substrate 7 of the thermal head X5, because the first portion 427*a* is applied to a large area. However, since the first portion 427*a* includes the pigment 20, the visibility of the first portion 427*a* is improved, and the thermal head X5 can be manufactured with high precision.

In contrast, the second portion 127*b* and the third portion 127*c* are applied to a small area, because the second portion 127*b* needs to be disposed only in the gap 16 between the first portion 427*a* and on the bulging portion 13*a*. Therefore, it is easy to adjust the amount of the second portion 127*b* and the third portion 127*c* to be applied, and the application state of the second portion 127*b* and the third portion 127*c* can be managed without performing a visual check. Thus, the second portion 127*b* and the third portion 127*c* need not include the pigment 20.

In the thermal head X5 shown in FIG. 10, the first portion 427*a* includes the filler 18 and the pigment 20. However, the first portion 427*a* may include only the filler 18 or only the pigment 20.

In the example shown in FIG. 10, the second portion 127*b* and the third portion 127*c* do not include the filler 18 and the pigment 20. However, the second portion 127*b* or the third portion 127*c* may not include the filler 18 and the pigment 20.

The present invention is not limited to the embodiments described above, which can be modified in various ways within the spirit and scope of the present invention. For example, the thermal printer Z1 includes the thermal head X1 according to the first embodiment. This is not a limitation, and the thermal printer Z1 may include any one of the thermal heads X2 to X5. The thermal heads X1 to X5 according to the embodiments may be used in combination.

For example, in the thermal head X1, the covering layer 27 is disposed on the upstream side and on the downstream side of the heating elements 9 in the transport direction S of the recording medium P. Alternatively, the covering layer 27 may be disposed only on the upstream side in the transport direction S, or the covering layer 27 may be disposed only on the downstream side in the transport direction S. Even when the covering layer 27 is disposed on the upstream side and on the downstream side in the transport direction S, the first to fifth embodiments may be applied to one of the upstream side and the downstream side. Different embodiments may be applied to the covering layer 27 disposed on the upstream side and the covering layer 27 disposed on the downstream side.

In the examples described above, the thermal heads are thin-film heads in which the resistor layer 15 is formed as a thin film and the heating elements 9 are thin. However, this is not a limitation. The present invention may be used for a thick-film head including thick heating elements 9 in which the resistor layer 15 is formed as a thick film after patterning various electrodes.

In the examples described above, the thermal heads are planar heads in which the heating elements 9 are formed on the first main surface 7*f* of the substrate 7. However, the present invention may be used for an end-surface head in which the heating elements 9 are formed on an end surface of the substrate 7.

A region in the heat storage layer 13 excluding the bulging portion 13*a* may include an underlying layer (not shown).

The heating elements 9 may be formed by forming the common electrode 17 and the individual electrodes 19 on the heat storage layer 13 and forming the resistor layer 15 only in regions between the common electrode 17 and the individual electrodes 19.

The sealing member 12 may be made of a material that is the same as that of the hard coating 29, which covers the drive ICs 11. In this case, the hard coating 29 and the sealing member 12 may be simultaneously formed by performing printing on a region in which the sealing member 12 is formed when printing the hard coating 29.

REFERENCE SIGNS LIST

X1 to X5 thermal head
Z1 thermal printer
1 heat sink
3 head base body
7 substrate
9 heating element
11 drive IC
12 sealing member
13 heat storage layer
13*a* bulging portion
14 adhesive member
25 protective layer
27, 127, 227, 327, 427 covering layer
27*a*, 327*a*, 427*a* first portion
27*b*, 127*b*, 227*b* second portion
127*c*, 227*c* third portion
31 connector

The invention claimed is:

1. A thermal head comprising:
a substrate;
a heat storage layer disposed on the substrate and comprising a bulging portion;
a heating element disposed on the bulging portion;
a protective layer disposed on the heating element; and
a covering layer disposed on the protective layer,
wherein the covering layer comprises
a first portion disposed apart from the bulging portion
a second portion disposed between the bulging portion and the first portion
wherein a height of the second portion from the substrate is smaller than a height of the first portion from the substrate, and
a third portion disposed on the bulging portion,
wherein an arithmetic-average surface roughness (Ra) of the third portion is smaller than an arithmetic-average surface roughness (Ra) of the second portion.

2. The thermal head according to claim 1,
wherein a thickness of the second portion is smaller than a thickness of the first portion.

3. The thermal head according to claim 1,
wherein a height of the third portion from the substrate is smaller than the height of the first portion from the substrate.

4. The thermal head according to claim 1,
wherein a height of the bulging portion from the substrate is smaller than the height of the first portion from the substrate.

5. The thermal head according to claim 1,
wherein the third portion is disposed on a region of the bulging portion that is not on the heating element.

6. The thermal head according to claim 1,
wherein an electrical resistance of the second portion is higher than an electrical resistance of the first portion.

7. The thermal head according to claim 1,
wherein the first portion and the second portion contain a bisphenol an epoxy resin, and
wherein a content ratio of the bisphenol an epoxy resin in the second portion is larger than a content ratio of the bisphenol an epoxy resin in the first portion.

8. A thermal printer comprising:
the thermal head according to claim 1;
a transport mechanism that transports a recording medium onto the heating element; and
a pressing mechanism that presses the recording medium against the heating element.

9. The thermal head according to claim 1,
wherein the third portion is disposed over an entire area of the bulging portion.

10. The thermal head according to claim 1,
wherein a thickness of the third portion is smaller than a thickness of the first portion.

11. The thermal head according to claim 10,
wherein a thickness of the second portion is smaller than the thickness of the first portion.

12. The thermal head according to claim 1,
wherein a height of the third portion from the substrate is greater than the height of the first portion from the substrate.

13. A thermal head comprising:
a substrate;
a heat storage layer disposed on the substrate and comprising a bulging portion;
a heating element disposed on the bulging portion;

a protective layer disposed on the heating element; and
a covering layer disposed on the protective layer,
wherein the covering layer comprises
a first portion disposed apart from the bulging portion,
a second portion disposed between the bulging portion and the first portion,
wherein a height of the second portion from the substrate is smaller than a height of the first portion from the substrate, and
wherein the covering layer is made of a resin, and
wherein the first portion contains a filler, and the second portion does not contain the filler.

14. A thermal head comprising:
a substrate;
a heat storage layer disposed on the substrate and comprising a bulging portion;
a heating element disposed on the bulging portion;
a protective layer disposed on the heating element; and
a covering layer disposed on the protective layer,
wherein the covering layer comprises
a first portion disposed apart from the bulging portion,
a second portion disposed between the bulging portion and the first portion,
wherein a height of the second portion from the substrate is smaller than a height of the first portion from the substrate, and
wherein the covering layer is made of a resin, and
wherein the first portion contains a pigment, and the second portion does not contain the pigment.

* * * * *